US010839821B1

(12) United States Patent
Jain et al.

(10) Patent No.: US 10,839,821 B1
(45) Date of Patent: Nov. 17, 2020

(54) SYSTEMS AND METHODS FOR ESTIMATING NOISE

(71) Applicant: Bose Corporation, Framingham, MA (US)

(72) Inventors: Ankita D. Jain, Westborough, MA (US); Cristian M. Hera, Lancaster, MA (US); Elie Bou Daher, Marlborough, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 16/519,762

(22) Filed: Jul. 23, 2019

(51) Int. Cl.
*G10L 21/0208* (2013.01)
*G10K 11/178* (2006.01)
*G10L 21/0216* (2013.01)

(52) U.S. Cl.
CPC ..... *G10L 21/0208* (2013.01); *G10K 11/178* (2013.01); *G10L 21/0216* (2013.01); *G10K 2210/3028* (2013.01)

(58) Field of Classification Search
None
See application file for complete search history.

(56) References Cited

U.S. PATENT DOCUMENTS 6,459,914 B1 * 10/2002 Gustafsson ..... G10L 21/0232 455/570
6,717,991 B1 * 4/2004 Gustafsson ..... H04R 3/005 375/285
9,607,603 B1 * 3/2017 Ebenezer ..... G10L 21/0208
2004/0002860 A1 * 1/2004 Deisher ..... G10L 21/0208 704/233
2007/0033020 A1 * 2/2007 (Kelleher) Francois ..... G10L 21/0208 704/226
2008/0027722 A1 * 1/2008 Haulick ..... G10L 21/0208 704/226
2011/0026724 A1 * 2/2011 Doclo ..... G10K 11/178 381/71.8
2011/0044461 A1 * 2/2011 Kuech ..... H04M 9/082 381/66
2011/0305345 A1 * 12/2011 Bouchard ..... G10L 21/0208 381/23.1
2017/0345439 A1 * 11/2017 Jensen ..... G10L 21/0232
2020/0074976 A1 * 3/2020 Torres ..... G10K 11/17853

* cited by examiner

*Primary Examiner* — Qin Zhu
(74) *Attorney, Agent, or Firm* — Bond, Schoeneck & King, PLLC

(57) ABSTRACT

An audio system includes a noise-estimation filter, configured to receive a magnitude-squared frequency-domain noise-reference signal and to generate a magnitude-squared frequency-domain noise-estimation signal; and a noise-reduction filter configured to receive a microphone signal from a microphone, the microphone signal including a noise component correlated to an acoustic noise signal, and to suppress the noise component of the microphone signal, based, at least in part, on the magnitude-squared frequency-domain noise-estimation signal, to generate a noise-suppressed signal.

17 Claims, 8 Drawing Sheets

SYSTEMS AND METHODS FOR ESTIMATING NOISE

BACKGROUND

The present disclosure relates to systems and methods for estimating noise.

SUMMARY

All examples and features mentioned below can be combined in any technically possible way.

According to an aspect, an audio system includes: a noise-estimation filter, configured to receive a magnitude-squared frequency-domain noise-reference signal and to generate a magnitude-squared frequency-domain noise-estimation signal; and a noise-reduction filter configured to receive a microphone signal from a microphone, the microphone signal including a noise component correlated to an acoustic noise signal, and to suppress the noise component of the microphone signal, based, at least in part, on the magnitude-squared frequency-domain noise-estimation signal, to generate a noise-suppressed signal.

In an example, the audio system further includes a frequency-transform module configured to receive a time-domain noise-reference signal and to output a frequency-domain noise-reference signal.

In an example, the audio system further includes a magnitude-squared module configured to receive the frequency-domain noise-reference signal and to output the magnitude-squared frequency-domain noise-reference signal.

In an example, the noise-reduction filter is configured to suppress the noise component of the microphone signal based, at least in part, on a power spectral density of the noise-estimation signal, wherein the power spectral density of the noise-estimation signal is the expected value of the magnitude-squared frequency-domain noise-estimation signal.

In an example, the noise-estimation filter is a Wiener filter.

In an example, the noise-estimation filter is an adaptive filter.

In an example, the adaptive filter is adapted based, at least in part, on an error signal, wherein the error signal is a difference between a power spectral density of the noise-estimation signal and a cross power spectral density of the microphone signal and an estimated noise signal.

In an example, the estimated noise signal is determined by subtracting the noise-suppressed signal from the microphone signal.

In an example, the noise-estimation filter is configured to receive a second magnitude-squared frequency-domain noise-reference signal, wherein the magnitude-squared frequency-domain noise-estimation signal is generated, at least in part, based on the magnitude-squared frequency-domain noise-reference signal and the second magnitude-squared frequency-domain noise-reference signal.

In an example, the magnitude-squared frequency-domain noise-reference signal is based on a time-domain noise-reference signal received from a noise-detection sensor.

In an example, the noise-detection sensor is the microphone.

According to another aspect, an audio system includes: a frequency-transform module configured to receive a noise-reference signal and to output a frequency-domain noise-reference signal; a magnitude-squared module configured to receive the frequency-domain noise-reference signal and to output the magnitude-squared frequency-domain noise-reference signal; a noise-estimation filter, configured to receive a magnitude-squared frequency-domain noise-reference signal and to generate a magnitude-squared frequency-domain noise-estimation signal; and a noise-reduction filter configured to receive a microphone signal from a microphone, the microphone signal including a noise component correlated to an acoustic noise signal, and to suppress the noise component of the microphone signal, based, at least in part, on the magnitude-squared frequency-domain noise-estimation signal, to generate a noise-suppressed signal.

In an example, the noise-reduction filter is configured to suppress the noise component of the microphone signal based, at least in part, on a power spectral density of the noise-estimation signal, wherein the power spectral density of the noise-estimation signal is the expected value of the magnitude-squared frequency-domain noise-estimation signal.

In an example, the noise-estimation filter is a Wiener filter.

In an example, the noise-estimation filter is an adaptive filter.

In an example, the adaptive filter is adapted based, at least in part, on an error signal, wherein the error signal is a difference between a power spectral density of the noise-estimation signal and a cross power spectral density of the microphone signal and an estimated noise signal.

According to another aspect, a method for suppressing noise in a microphone signal, includes receiving a noise-reference signal in the time domain; transforming, with a frequency-transform module, the noise-reference signal to the frequency domain to generate a frequency-domain noise-reference signal; finding, with a magnitude-squared module, a magnitude-squared of the frequency-domain noise-reference signal to generate a magnitude-squared frequency-domain noise-reference signal; generating, with a noise-estimation filter, a magnitude-squared frequency-domain noise-estimation signal based on the magnitude-squared frequency-domain noise-reference signal; and suppressing, with noise-reduction filter, a noise component of a microphone signal, based, at least in part, on the magnitude-squared frequency-domain noise-estimation signal, to generate a noise-suppressed signal.

In an example, the step of suppressing the noise-component of the microphone signal comprises suppressing the noise-component of the microphone signal based on a power spectral density of the noise-estimation signal, wherein the power spectral density of the noise-estimation signal is an expected value of the magnitude-squared frequency-domain noise-estimation signal.

In an example, the noise-estimation filter is a Wiener filter.

In an example, the noise-estimation filter is an adaptive filter.

These and other aspects of the various examples will be apparent from and elucidated with reference to the aspect(s) described hereinafter.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the various aspects.

DETAILED DESCRIPTION

In most noise reduction applications, an estimated noise signal is used as a reference signal to cancel an undesired noise signal. For example, in the context of a vehicle audio system, undesired acoustic road noise and other noise signals will be input to a microphone that is otherwise positioned to receive a user's voice—e.g., for the purposes of sending a speech signal to a handsfree phone subsystem. A noise-reduction filter, configured to suppress the undesired noise in the microphone signal, will typically require an estimate of the undesired road noise (and other noise) in the vehicle to perform its function.

However, if the noise-reduction filter (implemented in a vehicle or elsewhere) receives the noise-estimation signal in the time domain, it will, by definition, minimize error across all frequencies. Furthermore, since the noise-reduction filter minimizes the error in the time-domain signal, it minimizes the error in both the magnitude and phase of the target signal. But for many noise-suppression applications, the phase of the target signal is irrelevant, and thus the noise-reduction calculation becomes inappropriately constrained, thereby making the solution sub-optimal. Accordingly, there is a need in the art for an audio system with noise reduction that minimizes error on a frequency-by-frequency basis and is appropriately constrained.

Figure 1A:
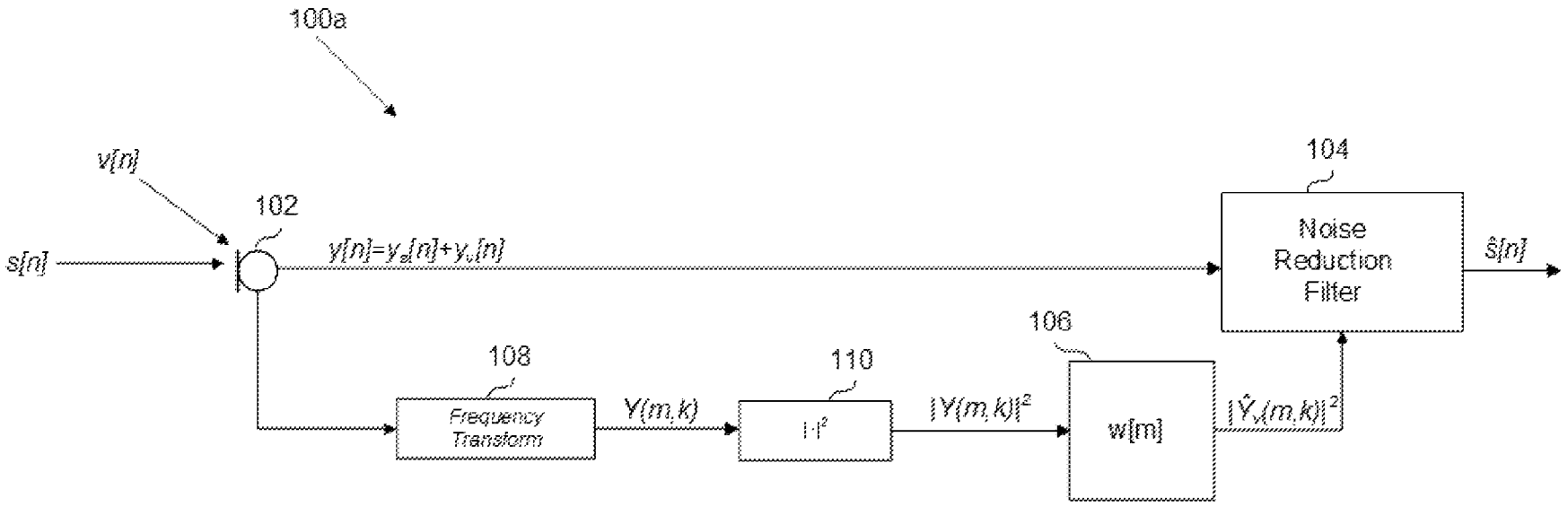
FIG. 1A shows a schematic of an audio system including a noise-estimation filter and a noise-reduction filter, according to an example.

There is shown in FIG. 1A, an audio system 100*a* that is configured to receive a microphone signal y[n] from at least one microphone 102, and to minimize a noise component $y_v[n]$ of the microphone signal y[n] with a noise-reduction filter 104 in order to produce an estimated speech signal $\hat{s}[n]$. Noise-reduction filter 104 receives the magnitude squared of a noise-estimation signal in the frequency domain, $|Y_v(m,k)|^2$, from a noise-estimation filter 106. The noise estimation filter 106, to generate the output $|Y_v(m,k)|^2$, receives the magnitude squared of a noise-detection microphone signal in the frequency domain, $|Y(m,k)|^2$. The magnitude squared of the noise-detection microphone signal in the frequency domain $|Y(m,k)|^2$ is generated, collectively, by a noise-detection microphone (which, in FIG. 1, is the same as microphone 102) and the output of the combination of frequency-transform module 108 and magnitude-square module 110.

In the example of FIG. 1, because the noise-reduction filter 104 receives the magnitude squared of the noise-detection signal, which no longer includes phase information as a result of the transformation into the frequency domain and the magnitude-squared operation, the noise suppression implemented by the noise-reduction filter 104 becomes appropriately constrained. In addition, because the noise-estimation is received in the frequency domain, noise reduction can be conducted on a frequency-by-frequency basis, permitting more configurability of audio system 100 (e.g., if desired, only certain frequency bands may receive noise suppression). As alluded to above, if the noise-estimation filter were, alternatively, to receive the noise-detection microphone signal y[n] in the time domain, the estimated noise output would simply be the time-domain noise-estimation signal, $\hat{y}_v[n]$, which would include phase information inherent to the time domain, and the noise-reduction filter 104 would minimize noise across all frequencies—neither of which are necessarily desirable.

Microphone 102 receives an acoustic speech signal s[n] from a user, and a noise signal, v[n], which may include components related to road noise, wind noise, etc. Microphone 102 generates a microphone signal y[n], which, accordingly, includes components related to the users speech, $y_s[n]$, and noise, $y_v[n]$. (In this disclosure, the argument n represents a discrete-time signal.) The microphone signal y[n] is received at the noise-reduction filter 104, which, as mentioned above, minimizes the noise component $y_v[n]$ in the microphone signal y[n] to generate the estimated speech signal $\hat{s}[n]$.

The microphone signal y[n] is also received at frequency-transform module 108, where it is transformed into a frequency domain signal Y(m,k), where m represents an index of frames (each frame comprising some set of L time samples) and k represents the frequency index. Frequency-transform module 108 may be implemented by any suitable frequency transform that buffers input time samples into frames and outputs an output representative of the frame of the time domain frames in the frequency domain. Such suitable frequency-transform modules include a short time Fourier transform (STFT) or a discrete cosine transform (DCT), although a person of ordinary skill in the art, in conjunction with a review of this disclosure will appreciate that other suitable frequency transformations may be used.

Figure 2:
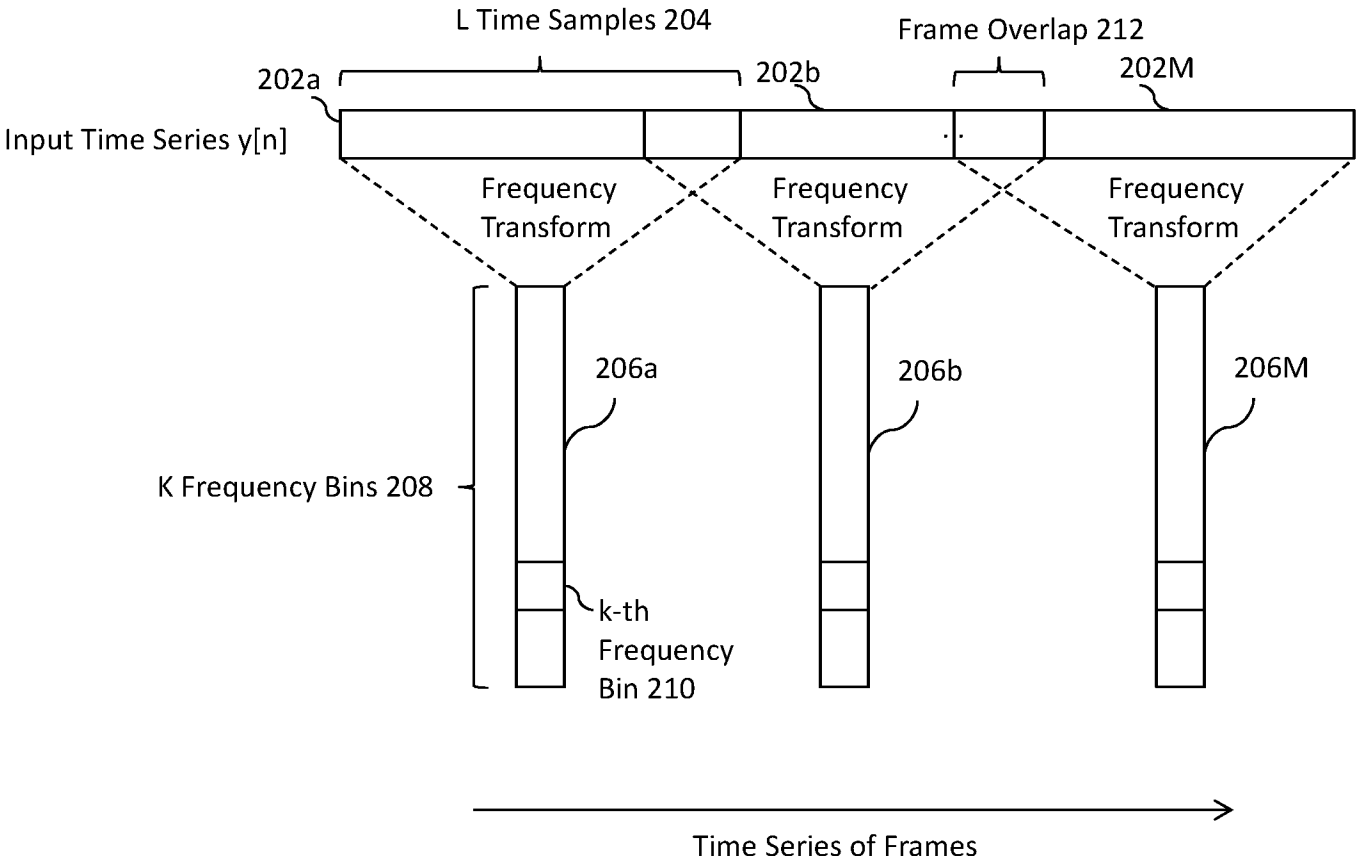
FIG. 2 shows a representation of a frequency transformation of a time-sampled signal into a time series of frequency-domain frames, according to an example.

FIG. 2 depicts an abstraction of the operation of frequency-transform module 108. As shown, the time domain signals y[n] are divided into a set of M time-domain frames 202, each including a set of L samples 204 of the time-domain signal y[n]. Each time-domain frame 202 is transformed into the frequency domain, so that each time-domain frame 202 is now transformed to a frequency-domain frame 206 including some K number of frequency bins 208, each $k^{th}$ bin 210 representing the magnitude and phase of the L time samples at the $k^{th}$ frequency value. The operation of the frequency-transform module 108 will therefore result in a time series of frequency-domain frames 206. Looking across the output time series of frames for a particular value k will render the change in the magnitude and phase of the $k^{th}$ frequency bin (e.g., denoted frequency bin 210) over time. Generally speaking, the time series of frequency-domain frames 206 does not represent the same sampling rate of the discrete-time microphone signal y[n], but rather a rate dictated by the advancement of frames. This may be conceived of as "frame time." However, it should be understood that, as shown in FIG. 2, there may be some overlap 212 in the frames, such that some subset of samples of y[n] are common between subsequent frames. The degree of overlap will determine the resolution of the time series of frames or "frame time."

The output Y(m,k) of the frequency-transform module 108 is input to the magnitude squared module 110, which outputs the magnitude squared of microphone signal in the frequency domain $|Y(m,k)|^2$. This operation effectively finds the sum of the squares of the real and imaginary parts of the Y(m,k) output, thus removing the phase information from Y(m,k).

The magnitude squared of the microphone output in the frequency domain $|Y(m,k)|^2$ is input to noise-estimation filter 106, which outputs an estimate of the noise component of the magnitude-squared frequency-domain microphone signal, denoted as $\|\hat{Y}_v(m,k)|^2$. The noise-estimation filter 106, as shown, is a linear time-invariant filter, such as a fixed Wiener filter, configured to determine the estimated noise signal (in an alternative example, as described below, the filter may be an adaptive filter rather than a fixed filter). Regardless of the type of filter used, the noise-estimation filter 106, which is typically configured to operate in the time domain, will now operate over a time series of frames in the frequency domain. The output of the noise-estimation filter 106, accordingly, is the magnitude squared of the noise-estimation signal in the frequency domain, $|Y_v(m,k)|^2$, determined per frame m and frequency bin k.

In the Wiener filter example, the noise-estimation filter 106 may determine the estimated noise signal by convolving the magnitude-squared frequency-domain noise signal $|Y(m,k)|^2$ with a transfer function w[m,k], according to the following equation:

$$|\hat{Y}(m,k)|^2 = w[m,k] * |Y(m,k)|^2 \tag{1}$$

where the convolution is applied along the "frame time" or m-axis. The transfer function w[m,k] is then unique for each $k^{th}$ frequency bin and may be determined a priori, using, for example, data collected during a tuning phase. For example, in the vehicle context, noise may be recorded at microphone 102, or some other representative sensor, while driving the vehicle over various surfaces. Using the recorded noise, which represents the target noise, the error $\tilde{e}[k]$ between the estimated magnitude squared frequency-domain estimated noise $|\hat{Y}_v(m,k)|^2$ and the magnitude squared frequency-domain of the recorded noise $|Y_{noise}(m,k)|^2$ may be minimized. This may be achieved by minimizing a cost function J[k] independently for each frequency bin as follows, the cost function being defined as:

$$\tilde{J}[k] = |\tilde{e}[k]|^2 = \sum_m \left| |Y_{noise}(m,k)|^2 - |\hat{Y}(m,k)|^2 \right|^2 \tag{2}$$

This cost function $\tilde{J}[k]$ may be minimized by solving the following derivative, according to known methods:

$$\frac{\partial J[k]}{\partial w[m,k]} = 0 \tag{3}$$

Intuitively, then, the transfer function w[m,k] estimates the noise signal in the presence of other signals (e.g., speech, music, navigation), based on the recorded noise. Although a Wiener filter has been described, it should be understood that any other suitable filter, such as L1 optimal filters, or $H_\infty$ optimal filters, may be used. In addition, while a fixed filter is shown in FIG. 1, it should be understood that the noise-estimation filter may be adaptive, as described in connection with FIGS. 4A and 4B.

Figure 1B:
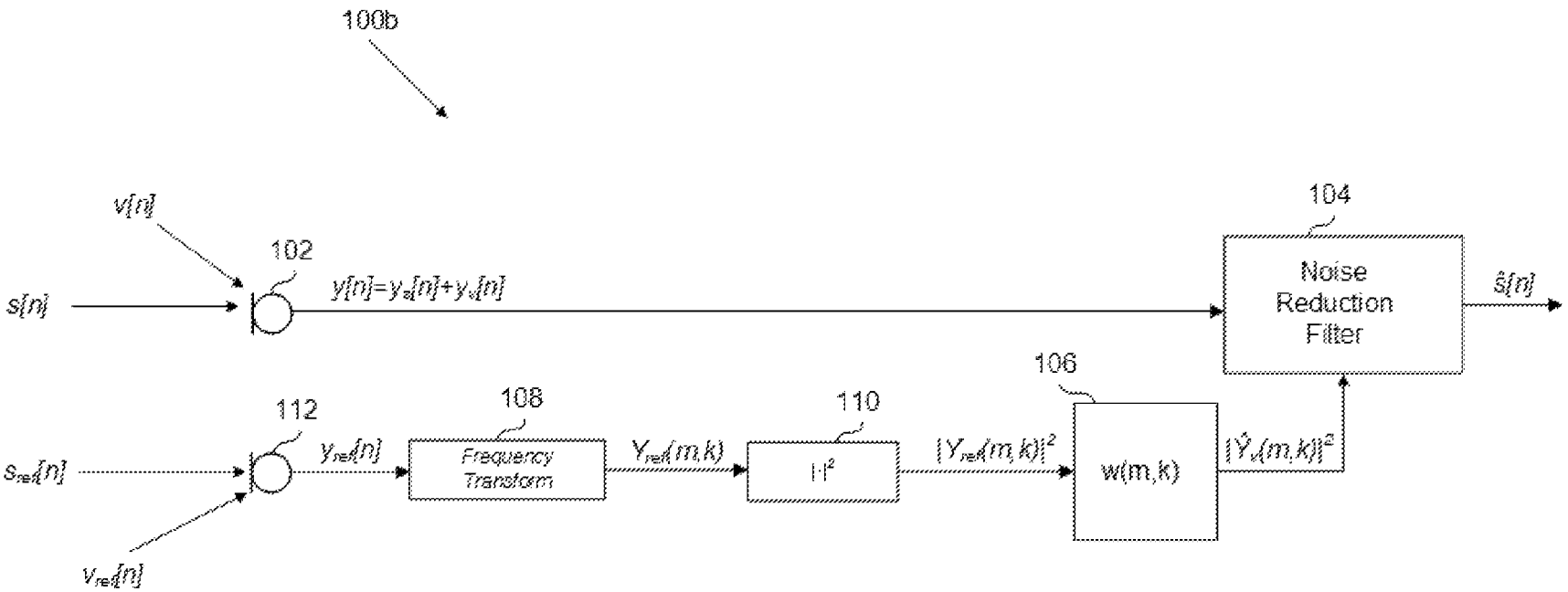
FIG. 1B shows a schematic of an audio system including a noise-estimation filter and a noise-reduction filter, according to an example.

FIG. 1B shows an alternative example in which a separate noise-detection sensor, shown as a noise-detection microphone 112, generates a noise-reference signal $y_{ref}[n]$, which is ultimately used to generate the magnitude squared of the noise-estimation signal in the frequency domain $|\hat{Y}_v(m,k)|^2$. Noise-detection microphone 112 receives an acoustic reference speech signal $s_{ref}[n]$ and a reference noise signal $v_{ref}[n]$, which differ, to some degree, from acoustic speech signal s[n] and noise signal v[n] because noise-detection microphone is spatially separated from microphone 102. Apart from using a separate noise-detection sensor, the operation of the audio system shown in FIG. 1B functions identically to the operation of audio system 100 shown in FIG. 1A. Thus, the output of noise-detection microphone 112, $y_{ref}[n]$, is input to frequency transform 108, which outputs the noise-reference signal in the frequency domain, denoted as $Y_{ref}(m,k)$. The noise-reference signal in the frequency domain is input to magnitude squared module 110, which outputs the magnitude squared frequency-domain noise reference signal $|Y_{ref}(m,k)|^2$, retaining only the sum of the squares of the real and imaginary components of the frequency transform output $Y_{ref}(m,k)$. The output of the magnitude squared module is input to the noise-estimation filter 106, which operates on the time series of frames, of which magnitude squared module 110 output $|Y_{ref}(m,k)|^2$ is comprised. Note that the noise reference signal need not contain only noise or some transform of the noise to be estimated.

While noise-estimation filter 106 can function in a manner described above, the transfer function of noise-estimation filter 106 will be tuned slightly differently. Because the noise-reference signal is no longer generated at microphone 102, but at noise-detection microphone 112, the transfer function w[m,k] is tuned to minimize noise at microphone 102, but detected at noise-detection microphone 112. Thus, during the tuning phase, noise may be collected, for example, at both microphone 112 and microphone 102. Thereafter, the transfer function w[m,k] is derived which will estimate the noise at microphone 102 based on the input of noise-detection microphone 112.

Although a noise-detection microphone 112 is shown in FIG. 1B, it should be understood that any suitable noise-detection sensor, such as an accelerometer, or any other internal signal representative of noise may be used. This may be implemented in the vehicle context by, for example, positioning microphone 102 in the dashboard and positioning noise-detection microphone 112 in some location advantageous for detecting a larger noise component in the vehicle cabin, such as in a vehicle door, compared to the microphone 102.

Figure 1C:
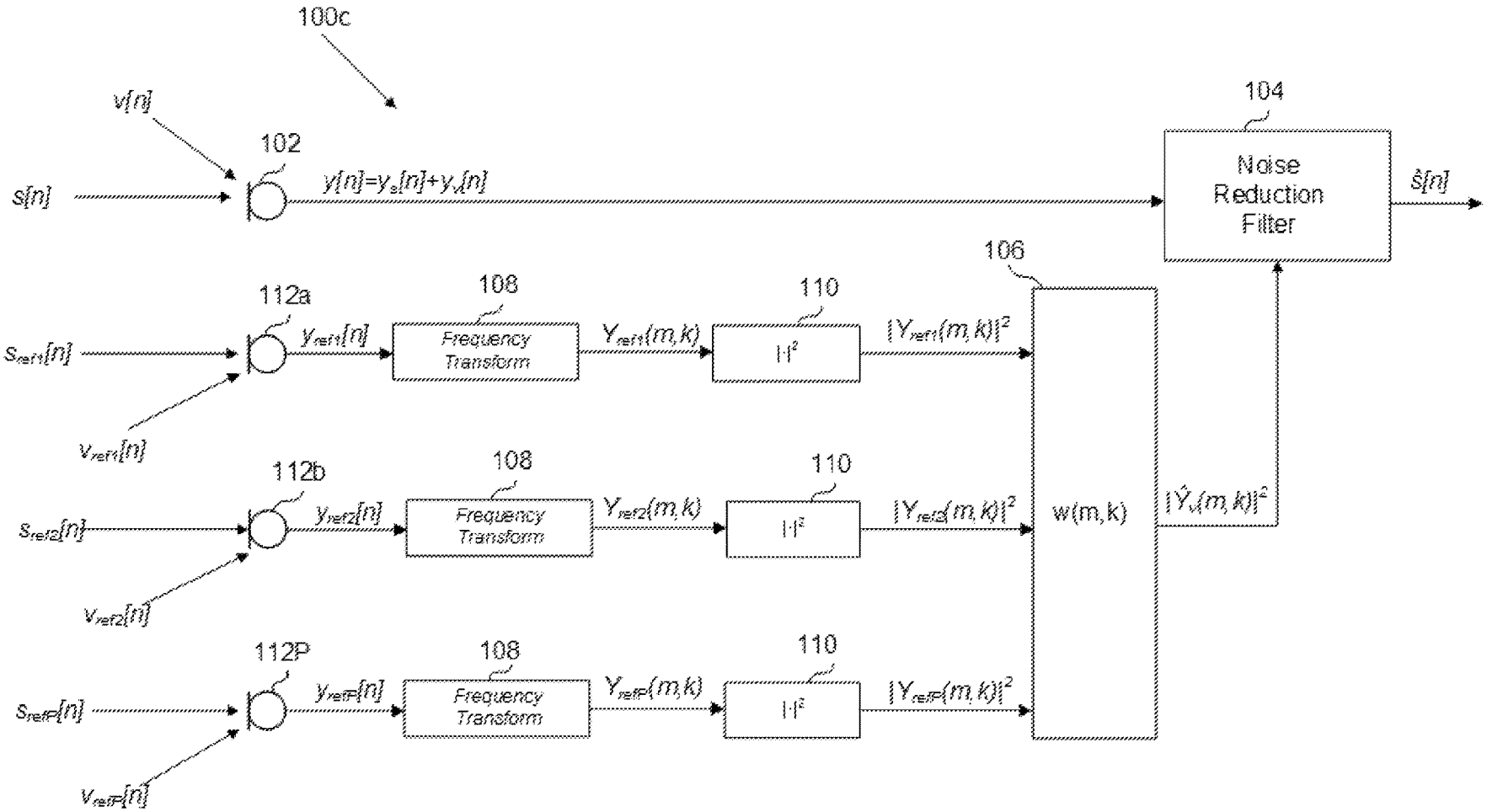
FIG. 1C shows a schematic of an audio system including a noise-estimation filter and a noise-reduction filter, according to an example.

In an alternative example, multiple noise-detection sensors may be used. An example of this is shown in FIG. 1C, which includes multiple noise-detection microphones 112. Each noise-detection microphone 112 will respectively produce a noise reference signal $y_{ref}[n]$, which is frequency transformed and input to a magnitude squared module, such that, for some P number of noise-detection microphones 112, P magnitude-squared frequency-domain noise reference signals $|Y_{ref}(m,k)|^2$ will be input to noise-estimation filter 106.

Noise-estimation filter sums together a noise-estimation signal determined for each input, in order to output the magnitude-squared frequency-domain noise-estimation signal $|\hat{Y}_v(m,k)|^2$. For example, in the Wiener filter example, the noise-estimation signal $|\hat{Y}_v(m,k)|^2$ may be determined according to the following summation:

$$\left|\hat{Y}(m,k)\right|^2 = \sum_{p=1}^{P} w_p[m,k] * |Y_p(m,k)|^2 \tag{4}$$

where p represents the noise-detection microphone 112 index. As shown in Eq. (4), a respective Wiener filter transfer function $w_p[m,k]$ may be determined and applied for each noise-detection microphone 112 and for each $k^{th}$ frequency bin. For example, in vehicle context, each transfer function $w_p[m,k]$ may be calculated by recording noise at microphone 102 and each noise-detection microphone 112, while driving the vehicle over various surfaces. Using the recorded noise at microphone 102, which represents the target noise, the error $\tilde{e}[k]$ between the estimated magnitude squared frequency-domain estimated noise $|\hat{Y}_v(m,k)|^2$ and the magnitude squared frequency-domain of the recorded noise at microphone 102, designated here as $|Y_{noise}(m,k)|^2$, may be minimized. This may be achieved by minimizing a cost function $\tilde{J}[k]$ independently for each frequency bin as follows, the cost function being defined as:

$$\tilde{J}[k] = |\tilde{e}[k]|^2 = \sum_m \left||Y_{noise}(m,k)|^2 - \left|\hat{Y}(m,k)\right|^2\right|^2 \tag{5}$$

This cost function $\tilde{J}[k]$ may be minimized for transfer function $w_p[m,k]$ by solving the following derivative, according to known methods:

$$\frac{\partial J[k]}{\partial w_p[m,k]} = 0, \text{ for all } p \tag{6}$$

Thus, each transfer function $w_p$, being respectively associated with the p-$^{th}$ noise-detection microphone 112, estimates the noise at microphone 102 in the presence of other signals (speech, music, navigation, etc.), based on the input from the respective noise-detection microphone 112.

The example of FIG. 1C may be implemented in the vehicle context, for example, by positioning microphone 102 in the dashboard and positioning the noise-detection microphones 112 in various locations about the cabin advantageous for detecting noise. Furthermore, it should be understood that, while noise-detection microphones 112 are shown in FIG. 1C any suitable noise-detection, such as accelerometers, or internal signal representative of noise, may be used. In addition, any combination of noise-detection sensors and/or internal signals may be used.

Figure 1D:
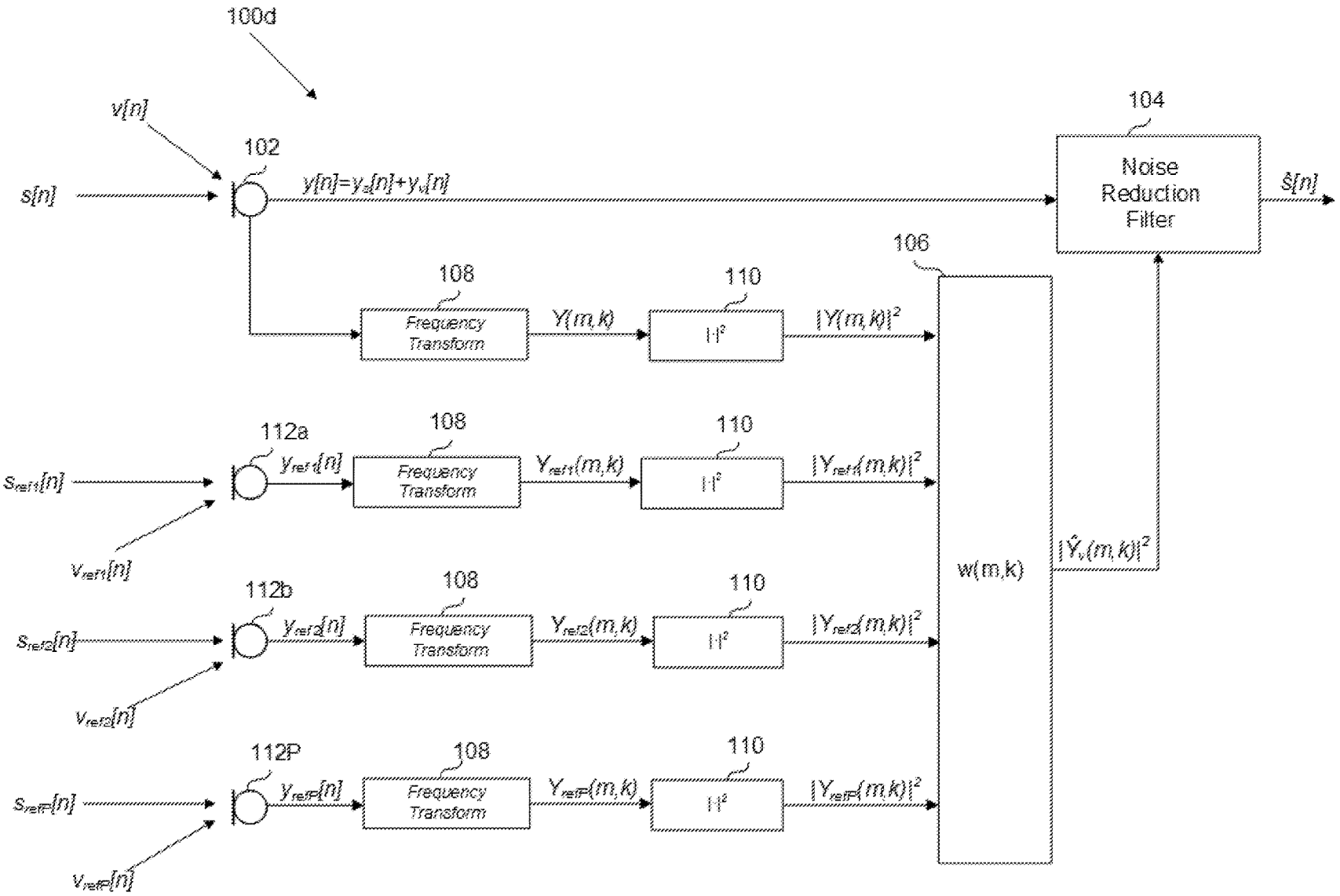
FIG. 1D shows a schematic of an audio system including a noise-estimation filter and a noise-reduction filter, according to an example.

In yet another example, shown in FIG. 1D, some combination of signals from microphone 102 and from at least one noise detection sensor may be used to generate the noise-estimation signal $|\hat{Y}_v(m,k)|^2$. This is shown in FIG. 1D, in which the signals from microphone 102 and from multiple noise-detection microphones 112 are used to generate the noise-estimation signal $|\hat{Y}_v(m,k)|^2$. Thus, noise-estimation filter 106 will receive a magnitude-squared frequency-domain noise reference signal $|Y(m,k)|^2$ from microphone 102 and some P number of magnitude-squared frequency-domain noise reference signals $|Y_{ref}(m,k)|^2$ from the P noise-detection microphones 112. In the Wiener filter example, the noise-estimation signal $|\hat{Y}_v(m,k)|^2$ may be determined according to the following equation:

$$\left|\hat{Y}(m,k)\right|^2 = w[m,k] * |Y(m,k)|^2 + \sum_{p=1}^{P} w_p[m,k] * |Y_p(m,k)|^2 \tag{7}$$

The values of transfer function w[m,k] and $w_p[m,k]$ may be determined according to the methods described above for each.

Figure 3:
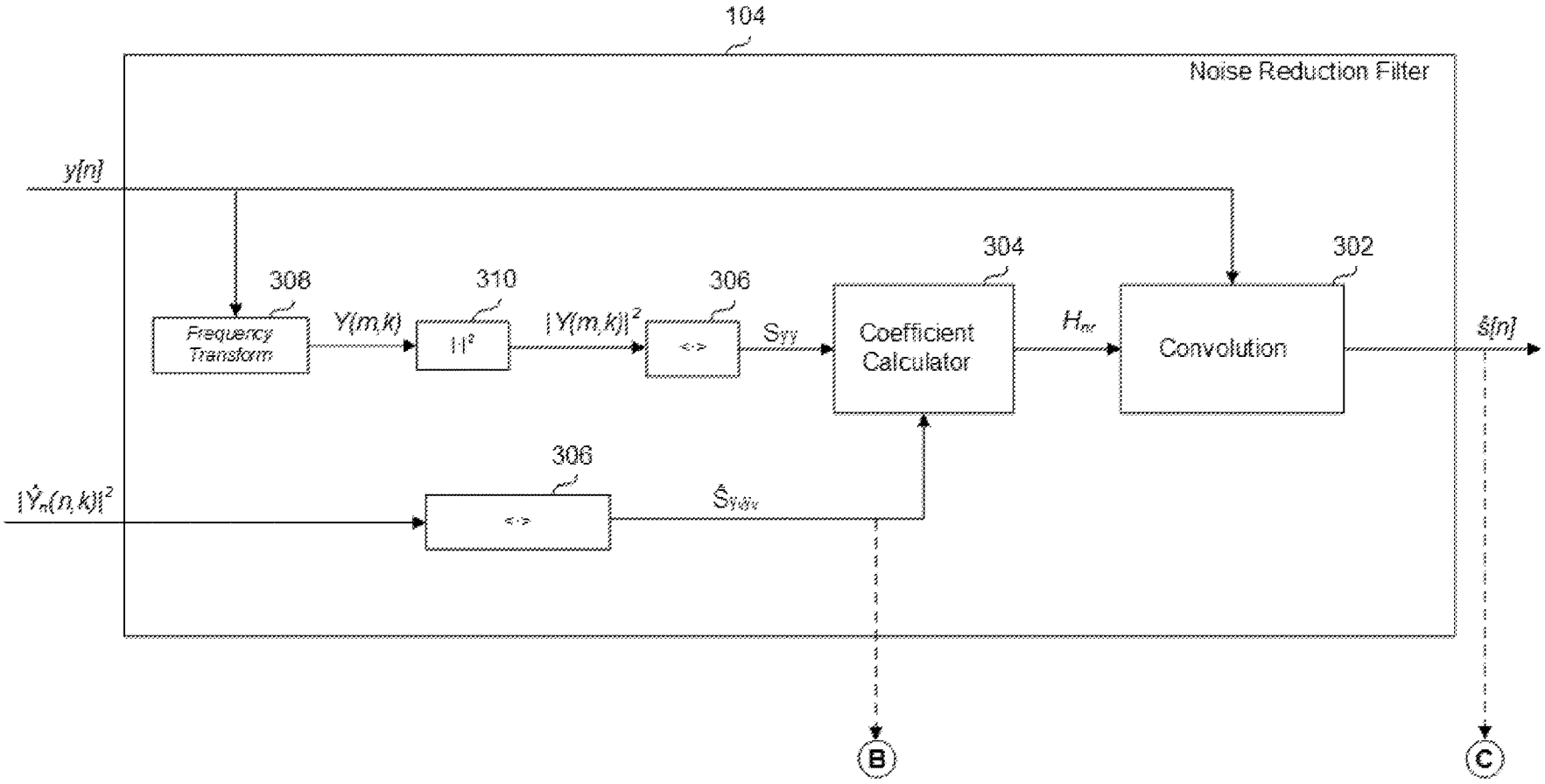
FIG. 3 shows a noise-reduction filter, according to an example.

In an example, the noise-reduction filter 104, shown in more detail in FIG. 3, generates the estimated speech signal $\hat{s}[n]$ based on the magnitude-squared frequency-domain noise-estimation signal $|\hat{Y}_v(m,k)|^2$. More particularly, in the example shown, the noise-reduction filter 104 suppresses noise in the microphone signal y[n] based on the magnitude-squared frequency-domain noise-estimation signal $|\hat{Y}_v(m,k)|^2$ to generate the estimated speech signal $\hat{s}[n]$.

In the example shown, the convolution module 302 convolves, in the time domain, each sample, with a coefficient $h_{nr}$, which is the time-domain representation of the frequency domain coefficient, $H_{nr}$, that is determined by coefficient calculator 304 according to the magnitude-squared frequency-domain noise-estimation signal $|\hat{Y}_v(m,k)|^2$. More specifically, the coefficient $H_{nr}$ is determined according to the ratio of the power spectral density of the noise estimation $\hat{S}_{y_v y_v}$, and the power spectral density of the microphone signal $S_{yy}$, as follows:

$$H_{nr} = 1 - \frac{\hat{S}_{y_v y_v}}{S_{yy}} \tag{8}$$

Thus, the greater the power spectral density (PSD) of the noise estimation, $\hat{S}_{y_v y_v}$, with respect to the PSD of the microphone signal $S_{yy}$, the smaller the value of the coefficient $H_{nr}[k]$. Indeed, the value of $H_{nr}[k]$ will be closer to one in frequency bins in which the power of the noise-estimation signal $\hat{Y}_v[k]$ with respect to the microphone signal Y[k] is low and closer to zero in frequency bins in which the power of the noise-estimation signal $\hat{Y}_v[k]$ with respect to the microphone signal Y[k] is high. As mentioned above, the time-domain coefficient $h_{nr}[n]$ is convolved with the microphone signal y[n] in the time domain to render the estimated speech signal, as follows:

$$\hat{s}[n] = h_{nr}[n] * y[n] \tag{9}$$

Convolution in the time domain is equivalent to multiplication in the frequency domain. Thus, $H_{nr}$ is multiplied by the microphone signal Y[k] on a per frequency basis. As a result, frequency bins of the microphone signal Y[k] in which the power of the noise-estimation signal $\hat{Y}_v[k]$ with respect to the microphone signal Y[k] is high, will be attenuated, because $H_{nr}[k]$ will be closer to zero; whereas, frequency bins of the microphone signal Y[k] in which the power of the noise-estimation signal $\hat{Y}_v[k]$ with respect to the microphone signal Y[k] is low, will be less attenuated, because $H_{nr}[k]$ will be closer to one.

Finding the PSD of the received magnitude-squared frequency-domain noise-estimation signal $|\hat{Y}_v(m,k)|^2$ is a matter of finding its expected value (i.e., its mean). Stated differently, the PSD of the magnitude-squared frequency-domain noise-estimation signal) $|\hat{Y}_v(m,k)|^2$ is equal to the expected value of the magnitude-squared frequency-domain noise-estimation signal $<|\hat{Y}_v(m,k)|^2>$. The expected value is found by the expected value module 306, which outputs the PSD of the noise-estimation signal $\hat{S}_{y_v y_v}$, to the coefficient calculator.

Similarly, to find the PSD of the microphone signal y[n], the microphone signal y[n] is input to frequency-transform module 308, magnitude squared module 310, and expected value module 306, to render the expected value of the magnitude-squared of the microphone signal in the frequency domain, which may be denoted as $<|Y(m,k)|^2>$ or $S_{yy}$. Like frequency-transform module 108, frequency-transform module may be implemented with any suitable frequency transform that buffers input time samples into frames and outputs an output representative of the frame of the time domain samples in the frequency domain. Such suitable frequency-transform modules include a short time Fourier transform (STFT) or a discrete cosine transform (DCT), although a person of ordinary skill in the art, in conjunction with a review of this disclosure, will appreciate that other suitable frequency transformations may be used.

Figure 4A:
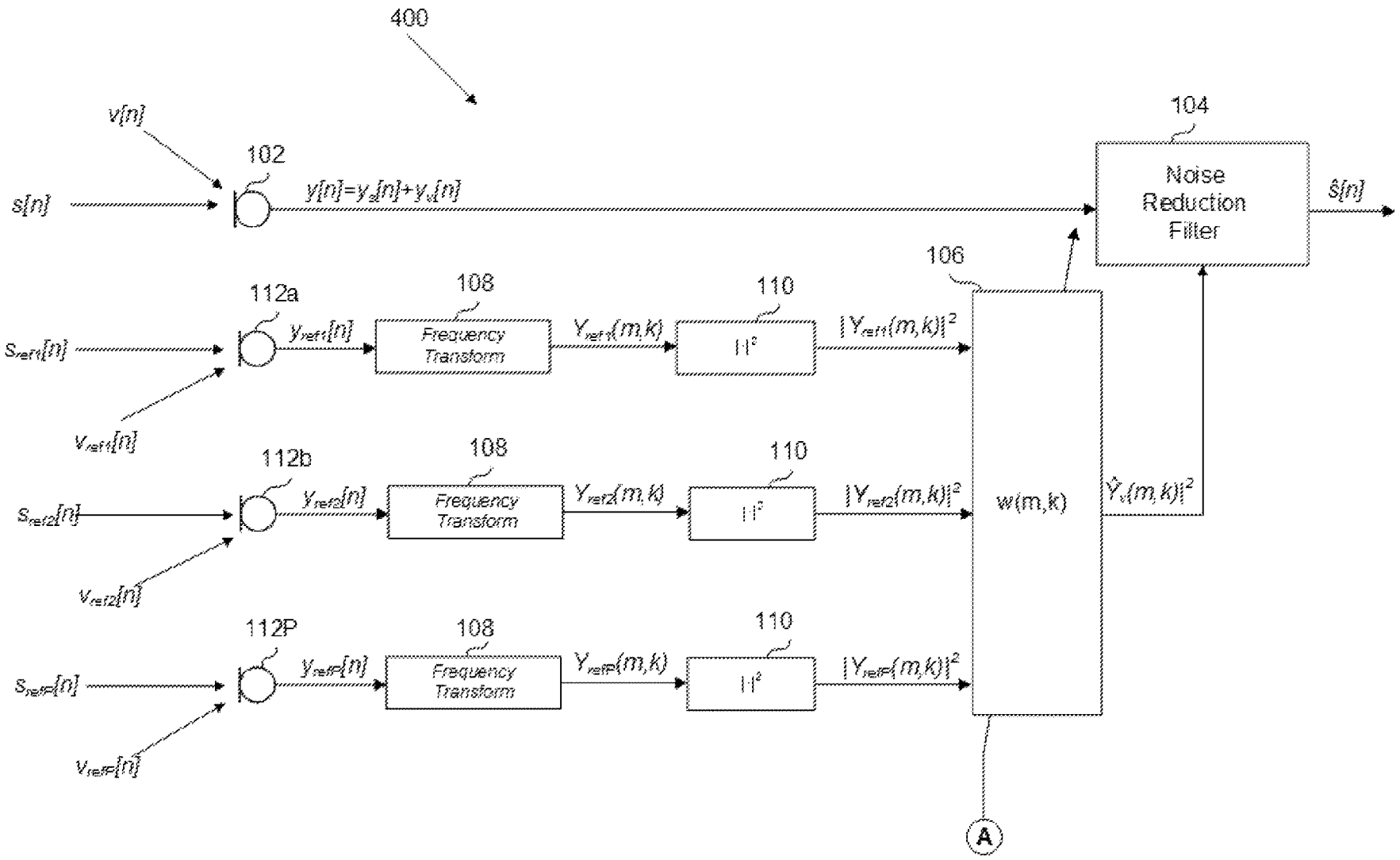
FIG. 4A shows a partial schematic of an audio system including an adaptive noise-estimation filter and a noise-reduction filter, according to an example.

As mentioned above, the noise-estimation filter 106 may be adaptive rather than fixed. An example of such an adaptive noise-estimation filter 106 is shown in FIG. 4A. In the example shown, adaptive noise-estimation filter 106 may receive a set of updated coefficients from coefficient updated module 402 (shown in FIG. 4B) each predetermined interval. The adaptation coefficients are shown received from A, which corresponds to the output of the coefficient adaptation module 402. The calculation of the adaptation coefficients and the coefficient adaptation are discussed in connection with FIG. 4B, below.

As shown, adaptive noise-estimation filter 106 generates the magnitude-squared frequency-domain noise-estimation signal $|\hat{Y}_v(m,k)|^2$ from inputs that originate from noise-detection microphones 112 (via frequency-transform module 108 and magnitude squared module 110). However, in alternative examples, it should be understood that the adaptive noise-estimation filter 106 can receive signals that originate from microphone 102, or some combination of microphone 102 and noise-detection microphones 112, as discussed in connection with FIGS. 1A-1D. Furthermore, as discussed previously, the adaptive noise-estimation filter 106 can receive noise signals that originate from accelerometers, or any other suitable noise-detection sensor, or suitable internal signals representative of noise.

Figure 4B:
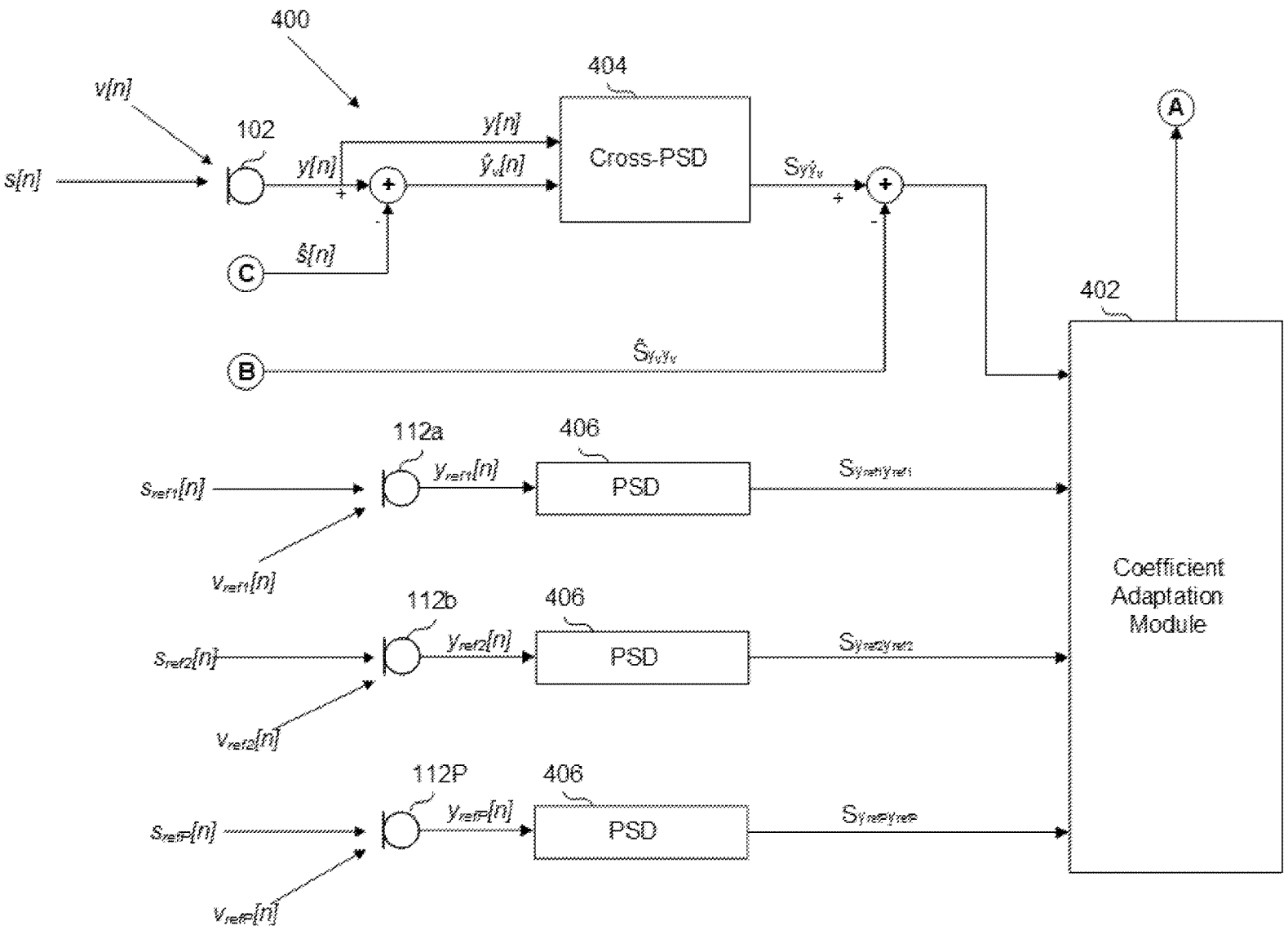
FIG. 4B shows a partial schematic of an audio system including an adaptive noise-estimation filter and a noise-reduction filter, according to an example.

FIG. 4B depicts an example of coefficient adaptation module 402, which calculates a coefficient update of the adaptive noise-estimation filter 106. The coefficient adaptation module can receive an error signal e[k] and the PSDs of the noise-detection microphones 112 in order to calculate the step direction of the adaptive noise-estimation filter. The error signal e[k] is determined by subtracting from the cross-PSD, found at cross-PSD module 404, of the microphone signal y[n] and the estimated noise signal $\hat{y}_v[n]$, denoted as $S_{y\hat{y}_v}$, the PSD of the noise-estimation signal $\hat{S}_{y_v y_v}$, as follows:

$$e[k]=S_{y\hat{y}_v}-\hat{S}_{y_v y_v} \tag{10}$$

Assuming that noise and speech are independent, the cross-PSD of the microphone signal y[n] and the estimated noise signal $\hat{y}_v[n]$, $S_{y\hat{y}_v}$, should converge to the cross-PSD of the noise-estimation signal and the true noise signal $S_{\hat{y}_v y_v}$, which, in turn, converges to the auto PSD of the true noise $S_{y_v y_v}$ and the auto PSD of the estimated noise signal $\hat{S}_{y_v y_v}$ as the system converges towards the true noise estimate Thus, subtracting the cross-PSD $S_{y\hat{y}_v}$ from the PSD of the noise-estimation signal $\hat{S}_{y_v y_v}$ renders an error signal representing a disparity between the noise-estimation signal and the actual noise.

The PSD of the noise-estimation signal $\hat{S}_{y_v y_v}$ is shown in FIG. 3 as a dotted line to B (the line is dotted to represent that this connection only exists in the example of audio system 400 including the adaptive noise-estimation filter 106).

The cross-PSD of the microphone signal y[n] and the estimated noise signal $\hat{y}_v[n]$, $S_{y\hat{y}_v}$, may be calculated by cross-PSD module, which receives as inputs the microphone signal y[n] and the estimated noise signal $\hat{y}_v[n]$. Such methods of calculating a cross-PSD are known in the art and do not require further discussion here. The estimated noise signal in the time domain $\hat{y}_v[n]$ may be determined by subtracting the estimated speech signal $\hat{s}[n]$ (taken, e.g., from C in FIG. 3) from the microphone signal y[n], as shown in FIG. 4B.

The coefficient adaptation module may further receive the PSDs of the noise-detection microphones 112, as inputs. Although, the noise-detection microphones 112 are shown, it should be understood that the coefficient adaptation module 402 may receive the PSDs from microphone 102, any noise-detection sensor, and/or from an internal signal representative of noise, received at adaptive noise-estimation filter 106. The PSDs of these signals may, for example, be calculated by taking expected value of the magnitude squared of these signals in the frequency domain, or according to any other suitable method for finding the PSD of a signal.

The error signal e[k] may, alternatively be expressed as the cross-PSD of the microphone signal y[n] and the estimated noise signal $\hat{y}_v[n]$, $S_{y\hat{y}_v}$, minus the sum of the filter weighted PSDs of the nose-detection signals (e.g., from the noise-detection microphones 112). In the example of the Wiener implementation of the noise-estimation filter 106, this may be represented as:

$$e[k] = S_{y\hat{y}_v} - \sum_{p=1}^{P} W_p[m, k] S_{y_{refp} y_{refp}} \tag{11}$$

Thus, given the error e[k], and Eq. (11), which relates the filter weights to the error, a least-mean-square algorithm may be written that minimizes error e[k] by taking appropriately directed steps to follow the negative gradient of the error. Note that here the filter weights are represented in the frequency domain and can be transformed into the time domain by an appropriate inversion process like inverse Short Time Fourier Transform or inverse Discrete Cosine Transform, depending on the type of frequency domain representation used. Thus, the updating process can happen either in the frequency domain or the time domain.

It should be understood that there may be additional intervening processing between microphone 102 and noise-reduction filter 104. For example, in various examples, as described above, a filter may be disposed after microphone in order to virtually project the microphone to a different location within the cabin, such as at a user's mouth, to direct the microphone in a particular direction, or to perform some other useful processing. Additionally, or alternatively, the microphone signal y[n] may be filtered, e.g., with an echo cancellation filter and/or post filter, to minimize echo in the microphone signal y[n], that is, to remove the components of the microphone signal y[n] related to the acoustic production of speakers in a vehicle cabin (e.g., music, voice navigation, etc.).

In the above-described examples, the operation of the noise-reduction filter 104, receiving the frequency-transformed time-domain noise estimation signal $|Y_{ref}(m,k)|^2$, will be appropriately constrained. Furthermore, because the signal is in the frequency domain, only certain frequencies may be subjected to suppression (e.g., 0-300 Hz), thus providing greater configurability. It should be understood that, although the estimated noise is shown for use with a noise-reduction filter, it should be understood that the produced magnitude squared frequency domain estimated noise signal may be used in conjunction with any other system for which such a signal may be of use.

The output of audio system 100, 400 or any variations thereof (e.g., estimated speech signal $\hat{s}[n]$) may be provided to another subsystem or device for various applications and/or processing. Indeed, the audio system 100, 400 output may be provided for any application in which a noise-reduced voice signal is useful, including, for example, telephonic communication (e.g., providing the output to a far-end recipient via a cellular connection), virtual personal assistants, speech-to-text applications, voice recognition (e.g., identification), or audio recordings.

It should be understood that, in this disclosure, a capital letter used as an identifier or as a subscript represents any number of the structure or signal with which the subscript or identifier is used. Thus, noise-detection microphone 112P represents the notion that any number of noise-detection microphones 112 may be implemented in various examples. Indeed, in some examples, only one noise-detection microphone may be implemented. Likewise, noise-detection microphone signal $y_{refP}[n]$ represents the notion that any number of noise-detection microphone signals may be produced. It should be understood that, the same letter used for different signals or structures, e.g., noise-detection microphone 112P and noise-detection microphone signal represents $y_{refP}[n]$ the general case in which there exists the same number of a particular signal or structure. The general case, however, should not be deemed limiting. A person of ordinary skill in the art will understand, in conjunction with a review of this disclosure, that, in certain examples, a different number of such signals or structures may be used. Furthermore, the absence of a capital letter as an identifier or subscript does not necessarily mean that that the structure or signal or limited to the number of structure of signals shown.

The functionality described herein, or portions thereof, and its various modifications (hereinafter "the functions") can be implemented, at least in part, via a computer program product, e.g., a computer program tangibly embodied in an information carrier, such as one or more non-transitory machine-readable media or storage device, for execution by, or to control the operation of, one or more data processing apparatus, e.g., a programmable processor, a computer, multiple computers, and/or programmable logic components.

A computer program can be written in any form of programming language, including compiled or interpreted languages, and it can be deployed in any form, including as a stand-alone program or as a module, component, subroutine, or other unit suitable for use in a computing environment. A computer program can be deployed to be executed on one computer or on multiple computers at one site or distributed across multiple sites and interconnected by a network.

Actions associated with implementing all or part of the functions can be performed by one or more programmable processors executing one or more computer programs to perform the functions of the calibration process. All or part of the functions can be implemented as, special purpose logic circuitry, e.g., an FPGA and/or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only memory or a random-access memory or both. Components of a computer include a processor for executing instructions and one or more memory devices for storing instructions and data.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the inventive scope of the present disclosure.

What is claimed is:

1. An audio system, comprising:

a noise-estimation filter, configured to receive a magnitude-squared frequency-domain noise-reference signal and to generate a magnitude-squared frequency-domain noise-estimation signal being a magnitude-square frequency-domain estimation of a noise component, correlated to an acoustic noise signal, of a microphone signal from a microphone; and a noise-reduction filter configured to receive the microphone signal, the microphone signal including the noise component correlated to the acoustic noise signal, and to suppress the noise component of the microphone signal, based, at least in part, on the magnitude-squared frequency-domain noise-estimation signal, to generate a noise-suppressed signal in which the noise component is suppressed, wherein the noise-estimation filter is configured to receive a second magnitude-squared frequency-domain noise-reference signal, wherein the magnitude-squared frequency-domain noise-estimation signal is generated, at least in part, based on the magnitude-squared frequency-domain noise-reference signal and the second magnitude-squared frequency-domain noise-reference signal.

2. The audio system of claim 1, further comprising a frequency-transform module configured to receive a time-domain noise-reference signal and to output a frequency-domain noise-reference signal.

3. The audio system of claim 2, further comprising a magnitude-squared module configured to receive the frequency-domain noise-reference signal and to output the magnitude-squared frequency-domain noise-reference signal.

4. The audio system of claim 1, wherein the noise-reduction filter is configured to suppress the noise component of the microphone signal based, at least in part, on a power spectral density of the noise-estimation signal, wherein the power spectral density of the noise-estimation signal is the expected value of the magnitude-squared frequency-domain noise-estimation signal.

5. The audio system of claim 1, wherein the noise-estimation filter is a Wiener filter.

6. The audio system of claim 1, wherein the noise-estimation filter is an adaptive filter.

7. The audio system of claim 6, wherein the adaptive filter is adapted based, at least in part, on an error signal, wherein the error signal is a difference between a power spectral density of the noise-estimation signal and a cross power spectral density of the microphone signal and an estimated noise signal.

8. The audio system of claim 7, wherein the estimated noise signal is determined by subtracting the noise-suppressed signal from the microphone signal.

9. The audio system of claim 1, wherein the magnitude-squared frequency-domain noise-reference signal is based on a time-domain noise-reference signal received from a noise-detection sensor.

10. The audio system of claim 9, wherein the noise-detection sensor is the microphone.

11. An audio system, comprising:

a frequency-transform module configured to receive a noise-reference signal and to output a frequency-domain noise-reference signal;

a magnitude-squared module configured to receive the frequency-domain noise-reference signal and to output the magnitude-squared frequency-domain noise-reference signal;

a noise-estimation filter, configured to receive a magnitude-squared frequency-domain noise-reference signal and to generate a magnitude-squared frequency-domain noise-estimation signal being a magnitude-square frequency-domain estimation of a noise component, correlated to an acoustic noise signal, of a microphone signal from a microphone; and a noise-reduction filter configured to receive the microphone, the microphone signal including the noise component correlated to the acoustic noise signal, and to suppress the noise component of the microphone signal, based, at least in part, on the magnitude-squared frequency-domain noise-estimation signal, to generate a noise-suppressed signal in which the noise component is suppressed, wherein the noise estimation filter is an adaptive filter, wherein the noise-estimation filter is adapted based, at least in part, on an error signal, wherein the error signal is a difference between a power spectral density of the noise-estimation signal and a cross power spectral density of the microphone signal and an estimated noise signal.

12. The audio system of claim 11, wherein the noise-reduction filter is configured to suppress the noise component of the microphone signal based, at least in part, on a power spectral density of the noise-estimation signal, wherein the power spectral density of the noise-estimation signal is the expected value of the magnitude-squared frequency-domain noise-estimation signal.

13. The audio system of claim 11, wherein the noise-estimation filter is a Wiener filter.

14. A method for suppressing noise in a microphone signal, comprising:

receiving a noise-reference signal in the time domain;

transforming, with a frequency-transform module, the noise-reference signal to the frequency domain to generate a frequency-domain noise-reference signal;

finding, with a magnitude-squared module, a magnitude-squared of the frequency-domain noise-reference signal to generate a magnitude-squared frequency-domain noise-reference signal;

generating, with a noise-estimation filter, a magnitude-squared frequency-domain noise-estimation signal based on the magnitude-squared frequency-domain noise-reference signal being a magnitude-square frequency-domain estimation of a noise component, correlated to an acoustic noise signal, of a microphone signal from a microphone signal, wherein the magnitude-squared frequency-domain noise-estimation signal is generated, at least in part, based on the magnitude-squared frequency-domain noise-reference signal and a second magnitude-squared frequency-domain noise-reference signal; and suppressing, with noise-reduction filter, the noise component of the microphone signal, the noise component correlated to the acoustic noise signal, based, at least in part, on the magnitude-squared frequency-domain noise-estimation signal, to generate a noise-suppressed signal in which the noise component is suppressed.

15. The method of claim 14, wherein the step of suppressing the noise-component of the microphone signal comprises suppressing the noise-component of the microphone signal based on a power spectral density of the noise-estimation signal, wherein the power spectral density of the noise-estimation signal is an expected value of the magnitude-squared frequency-domain noise-estimation signal.

16. The method of claim 14, wherein the noise-estimation filter is a Wiener filter.

17. The method of claim 14, wherein the noise-estimation filter is an adaptive filter.

* * * * *